United States Patent [19]

Falconieri et al.

[11] Patent Number: 4,983,056

[45] Date of Patent: Jan. 8, 1991

[54] CONNECTABLE CARTRIDGES FOR COMPATIBLE TYPING AND CORRECTION RIBBONS

[75] Inventors: Remo Falconieri, S. Giorgio C.se; Sergio Uggetti, Ivrea, both of Italy

[73] Assignee: Ing. C. Olivetti & C., S.p.A., Ivrea, Italy

[21] Appl. No.: 310,687

[22] Filed: Feb. 15, 1989

[30] Foreign Application Priority Data

Feb. 22, 1988 [IT] Italy ..... 67132 A/88

[51] Int. Cl.[5] ..... B41J 35/28; B41J 29/36

[52] U.S. Cl. ..... 400/208; 400/697

[58] Field of Search ..... 400/185, 194, 195, 196, 400/196.1, 207, 208, 208.1, 248, 695, 696, 697, 697.1, 225

[56] References Cited

U.S. PATENT DOCUMENTS

| | | | |
|---|---|---|---|
| 4,010,839 | 3/1977 | Guerrini et al. | 400/207 |
| 4,130,367 | 12/1978 | Guerrini et al. | 400/196 X |
| 4,239,107 | 12/1980 | Boyatt, Jr. et al. | 400/208 X |
| 4,247,210 | 1/1981 | Kacmarcik et al. | 400/697.1 X |
| 4,302,118 | 11/1981 | Schaefer | 400/208 |
| 4,329,072 | 5/1982 | Kacmarcik | 400/696 X |
| 4,347,007 | 8/1982 | Schaefer | 400/208 |
| 4,353,657 | 10/1982 | Schaefer | 400/208 |
| 4,397,575 | 8/1983 | Aldrich | 400/225 X |
| 4,606,662 | 8/1986 | Komplin | 400/208 X |
| 4,637,744 | 1/1987 | Valle et al. | 400/185 |

FOREIGN PATENT DOCUMENTS

| | | | |
|---|---|---|---|
| 0014763 | 12/1979 | European Pat. Off. . | |
| 0191184 | 11/1983 | Japan | 400/208 |

OTHER PUBLICATIONS

IBM Technical Disclosure Bulletin, "Cartridge with Ribbon and Correction Tape Guide", Greenlief et al., vol. 26, No. 1, Jun. 1983, pp. 299–300.

*Primary Examiner*—Edgar S. Burr
*Assistant Examiner*—C. A. Bennett
*Attorney, Agent, or Firm*—Banner, Birch, McKie & Beckett

[57] ABSTRACT

A cartridge for a typewriter typing ribbon comprises a container for accommodating the typing ribbon which can be of correctable or non-correctable type. A corrector cartridge can be removably fixed on the lower part of the container by engagement means. The corrector cartridge accommodates a correction ribbon which can be of the lift-off type suitable for the typing ribbon of correctable type, or of the cover-up correction type which is suitable for the typing ribbon of non-correctable type. Coupling means on the cartridge and the corrector cartridge permit the engagement means removably to fix the corrector cartridge to the container only when the caartridge houses the typing ribbon of correctable type and the corrector cartridge houses the correction ribbon of lift-off type or alternatively when the typing ribbon is of non-correctable type and the correction ribbon is of the cover-up type. In the event of a different choice, the coupling means prevent the engagement means from operating when the ribbons are not compatible with each other. Fixing means removably fix the container to a support of the typewriter either by itself or with the corrector cartridge attached and the fixing means do not cooperate and interfere with the engagement means and the coupling means.

19 Claims, 4 Drawing Sheets

CONNECTABLE CARTRIDGES FOR COMPATIBLE TYPING AND CORRECTION RIBBONS

BACKGROUND OF THE INVENTION

1 Field of the Invention

This invention relates to a cartridge for a typing or correction ribbon for typewriters, comprising a container for accommodating a typing ribbon or a correction ribbon and engagement means for engaging with the container a correction cartridge or a typing cartridge respectively which in turn contains a corresponding correction ribbon or typing ribbon respectively, to form a unitary typing and correction cartridge.

2 Description of the Prior Art

European patent application No. 0 014 763 discloses a typing cartridge of the above-defined type, with which it is possible to engage a cartridge for a correction ribbon in such a way as to form a unitary typing and correction cartridge which can be removably fitted to the typewriter.

It is also known that cartridges for a typing ribbon which can be used in recent typewriters may accommodate typing ribbons of various types. The characters which are typed by mistake can then be corrected by striking the incorrect character again, with the interposition of a correction ribbon which is also fitted on the machine.

In the situation where the cartridge accommodates a correctable typing ribbon, the incorrect characters can be cancelled on the page by using a cancellation or lift-off ribbon, the composition of which is such as to operate selectively on the typed characters, cancelling them by lifting them off the page and not leaving any obvious "trace" of the erased character, in a manner known per se. However that type of ribbon does not have any effect on characters which are typed with non-erasable ribbons. In the situation where the typing cartridge uses a non-erasable ribbon, the typed characters cannot be cancelled but they can be corrected by covering them over, using a cover-up ribbon which is provided with pigments of the same colour as the page but which does however leave a more or less apparent "trace" of the character which was previously typed.

In general, the best correction of an incorrectly typed character requires a corresponding type of correction ribbon, for each type of typing ribbon used, the correction ribbon being so selected as to operate in the optimum fashion with the typing ribbon used. In the case of known typing cartridges, the presence of a correctable ribbon is indicated by a particular colour (typically yellow) of some particular components of the cartridge, for example the wheel for manual rewinding of the ribbon.

Correct use of a lift-off ribbon with the corresponding correctable typing ribbon is facilitated by using the same colour (yellow) for the reels for winding on the lift-off ribbon, as that which is used for the characteristic parts of the cartridge for the typing ribbon. However, even if provided with an indicator in respect of the nature of the ribbon, the known typing or correction cartridges respectively do not prevent the operator from being able to couple to the typing cartridge a correction ribbon which is not operative and which is not of optimum compatibility with the typing ribbon cartridge which can be fitted to the machine.

SUMMARY OF THE INVENTION

The object of the invention is to provide a cartridge for a typing ribbon or a correction ribbon which is reliable and of limited cost and which can be easily coupled to a correction cartridge or a typing cartridge respectively in such a way as to form a unitary cartridge which can be removably fitted to the machine. In each case the typing and correction ribbons form a pair which is selected to optimize typing and cancellation or correction of the characters typed.

This object is met by the typing or correction cartridge according to the invention, which may be the typing cartridge to which a second cartridge for a correction ribbon may be attached. The first cartridge comprises a first container with engagement means for engaging the first container to a second container of the second cartridge. The two cartridges thereby form a unitary typing and correction cartridge. The first container has reference coupling means and the second container has a complementary coupling means. These coupling means permit functional operation of the engagement means only when there is a matching selection of the first and second cartridges. Accordingly, a lift-off ribbon correction cartridge can be engaged with a correctable typing ribbon cartridge. A cover-up ribbon correction cartridge can be engaged with a non-erasable typing ribbon cartridge but not with a correctable typing ribbon cartridge.

Alternatively the first cartridge may be the correcting ribbon cartridge and the second cartridge the typing ribbon cartridge.

Other features of the invention are the subject of the dependent claims and concern inter alia the provision of alignment means which ensure optimum assembly of a typing cartridge with a correction cartridge, independently of the presence of the selective coupling means of the correction cartridge.

BRIEF DESCRIPTION OF THE DRAWINGS

The following description sets forth a preferred embodiment of the invention which is given by way of non-limiting example with reference to the accompanying drawings in which.

DESCRIPTION OF THE PREFERRED EMBODIMENTS

Figure 1:
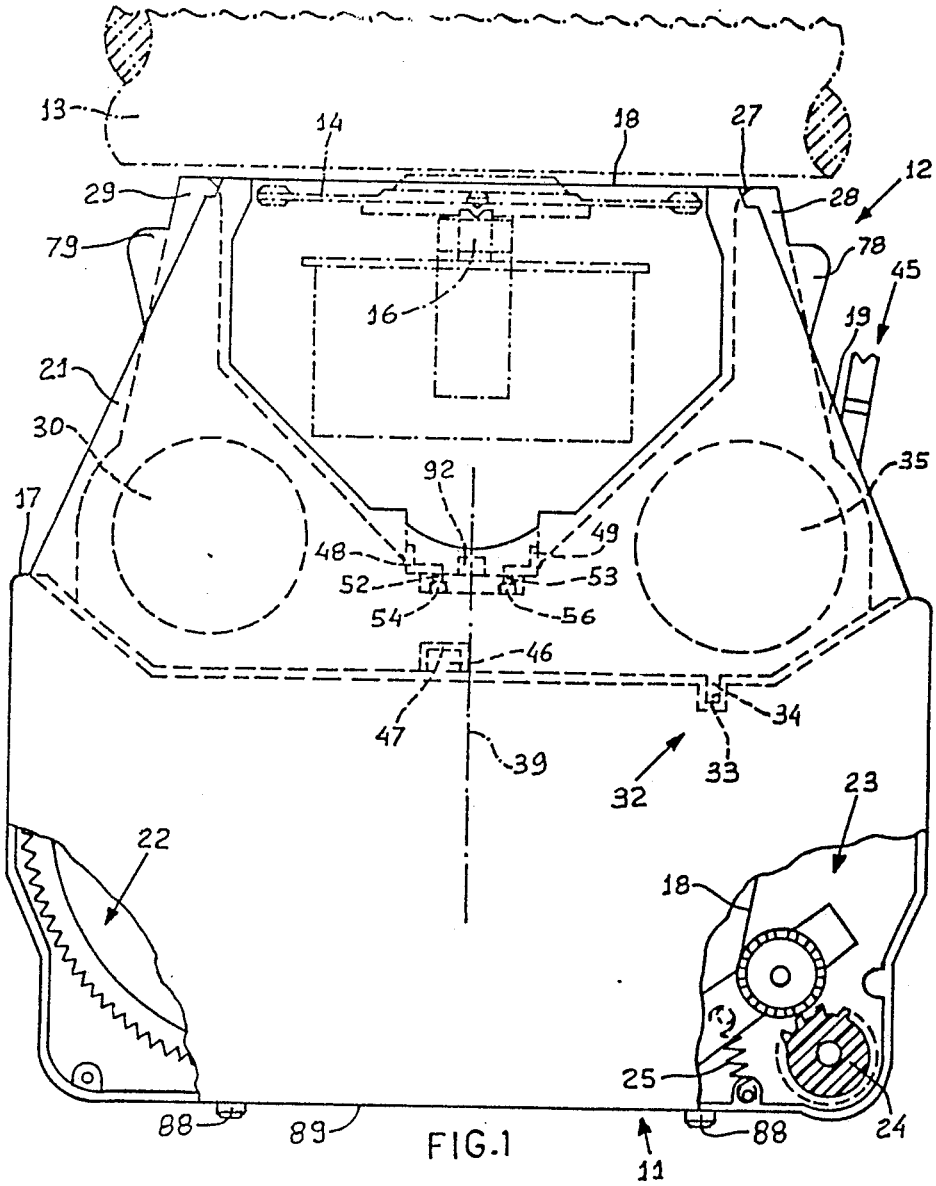
FIG. 1 is a plan view of part of a cartridge for an inked ribbon and a cartridge for a correction ribbon according to the invention, which are mounted on a typewriter.
Figure 2:
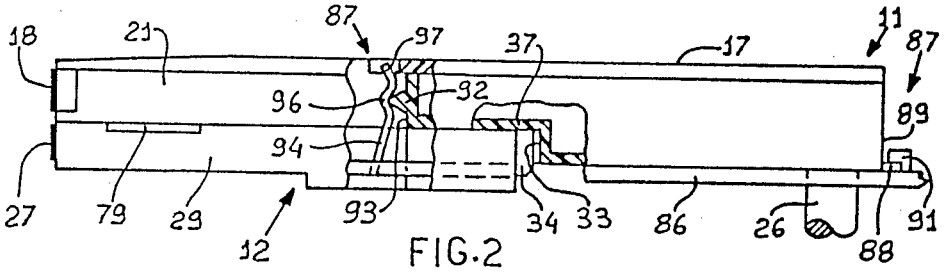
FIG. 2 is a side view of part of the two cartridges in FIG. 1.

Referring to FIGS. 1 and 2, the cartridge for a typing ribbon is generally indicated at 11 and the cartridge for the correction ribbon, which is defined as a corrector cartridge, is indicated generally at 12. The two cartridges 11 and 12 are mounted on a typewriter, for example an electronic typewriter, comprising a conventional platen roller 13, a character-carrying disc 14 and a striker 16. The roller 13, the disc 14 and the striker 16 are known per se and are shown diagrammatically in dash-dotted lines in the drawing and are not described in detail herein.

The cartridge 11 for the typing ribbon comprises a container 17 of plastics material, for accommodating a typing ribbon 18. The typing ribbon 18 may be of the single-strike erasable (correctable) type, with a support of polyethylene, of single-strike non-erasable type, with a support of polyethylene, or of multi-strike type with a support of mylar or of inked type with a support of fabric. The container 17 comprises two arms 19 and 21 which project to position an external portion of the typing ribbon 18 parallel to the platen roller 13.

In the cartridge 11 shown in FIGS. 1 and 2, the typing ribbon 18 is of single-strike correctable type and is housed within the container 17, being wound on a supply reel which is generally indicated at 22, while, after having been used for typing characters, it is rewound onto a receiving reel as generally indicated at 23. The receiving reel 23 is always in engagement with a toothed wheel 24 under the force of a spring 25 for the unidirectional feed movement of the typing ribbon 18. The toothed wheel 24 is driven in rotation by the drive shaft 26 of the machine, for example in the manner described in U.S. Pat. No. 4,010,839. A similar layout is used for the multi-strike ribbons with a mylar support, while the inked ribbons with a fabric support are of the closed loop type and are accommodated with their loops in a random arrangement in a magazine which is not illustrated in the drawings, for example of the type descibed in U.S. Pat. No. 4,130,367.

The corrector cartridge 12 is of plastics material and is arranged to accommodate a correction ribbon 27 and comprises two projecting arms 28 and 29 for positioning an external portion of the correction ribbon 27 parallel to the platen roller 13 and in coplanar relationship with the external portion of the typing ribbon 18. The correction ribbon 27 may be of the lift-off cancellation type which is suitable for and compatible with the typing ribbon 18 of correctable type known per se, or of the cover-up correction type which is suitable for the typing ribbon 18 of the non-erasable, single-strike, multi-strike and inked type. The correction ribbon 27 is selectively unwound from a supply reel 30 to a receiving reel 35 by means of a ratchet mechanism 45 of the machine, which operates on a toothed wheel 40 (see FIG. 11) of the receiving reel 35.

Figure 7:
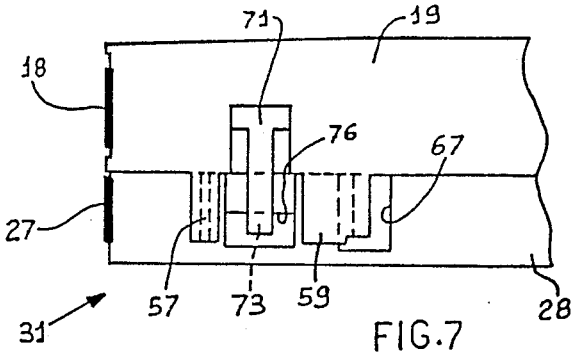
FIG. 7 is a partial side view of particular features from FIGS. 5 and 6 in the condition of being connected together and on an enlarged scale.
Figure 8:
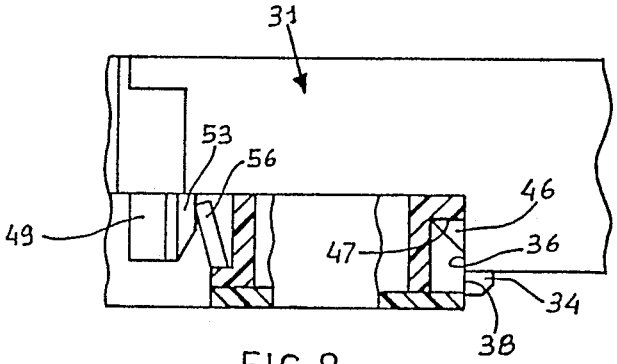
FIG. 8 is a partly sectional view of some features from FIG. 1 on an enlarged scale.
Figure 9:
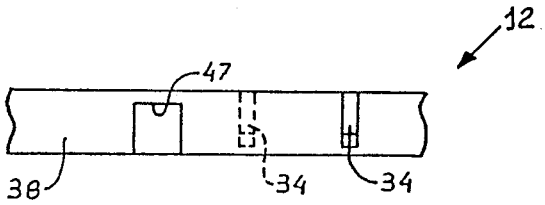
FIG. 9 is a rear view showing part of the correction cartridge in FIG. 1.
Figure 10:
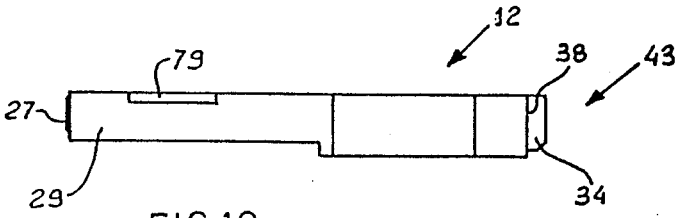
FIG. 10 is a side view showing part of the cartridge for a correction ribbon as shown in FIG. 1.

The container 17 (see FIG. 1) and the corrector cartridge 12 are removably fixed together by mutual fixing or engagement means which are generally indicated at 31 (see FIGS. 7 and 8) and correct matching of cartridges 11 and 12 is ensured by coupling means 32 which comprise means for selective coupling of the cartridge 11 and complementary coupling means for the cartridge 12 which are indicated generally at 42 and 43 (see FIGS. 3, 4, 11 and 12) and which permit the engagement means 31 removably to fix the corrector cartridge 12 to the container 17 when the typing ribbon 18 is of the correctable type and the typing ribbon 27 is of the lift-off type, and when the correction ribbon 18 is of the non-erasable type and the correction ribbon 27 is of the cover-up type. In addition the coupling means 32 prevent the engagement means 31 from cooperating with each other to fix the corrector cartridge 12 to the container 17 when the typing ribbon 18 is of the correctable type and the correction ribbon 27 is of the cover-up type and vice-versa when the typing ribbon 18 is of the non-erasable type and the correction ribbon 27 is of the lift-off type.

The coupling means 42 and 43 (see FIGS. 3, 4, 11 and 12) comprise a seat 33 and a limb 34 which are coupled together and which a seat 33 and a limb 34 which are coupled together and which are in one piece with the container 17 and the corrector cartridge 12. The seat 33 is provided in a wall 36 which projects from the bottom 37 of the arms 19 and 21 of the container 17. The limb 34 projects from a rear wall 38 of the corrector cartridge 12. The rear wall 38 is normally arrested against the projecting wall 36 of the container 17 when the corrector cartridge 12 is mounted with the container 17 and therefore the projecting wall 36 defines the position of the corrector cartridge 12. The seat 33 and the limb 34 are spaced from the central axis of symmetry 39 of the container 17 and the corrector cartridge 12 by predetermined distances which are variable according to whether the container 17 accommodates a typing ribbon 18 of the correctable type and the corrector cartridge 12 accommodates a correction ribbon 27 of the lift-off type or the container 17 accommodates a typing ribbon 18 of the non-erasable type and the corrector cartridge 12 accommodates a correction ribbon 27 of the cover-up type.

It will be apparent that if an attempt is made to join and connect together a container 17 and a corrector cartridge 12 in which the ribbons 18 and 27 are not compatible with each other, the limb 34 engages the edge of the projecting wall 36 and prevents the engagement means 31 from operating to fix the container 17 and the corrector cartridge 12 together.

In order to simplify the moulding operations and thus reduce costs, the projecting wall 36 of the container 17 comprises two pre-seats 33 which are almost totally closed by a strip 41 which can be easily broken while the rear wall 38 of the corrector cartridge 12 comprises two limbs 34. The two pre-seats 33 and the two limbs 34 are spaced from the central axis of symmetry 39 by predetermined distances which are unambiguously associated with the type of typing ribbon 18 and correction ribbon 27 accommodated in the container 17 and the corrector cartridge 12 respectively. One of the two pre-seats 33 is completely opened by removing the strip 41 and one of the two limbs 34 is completely removed during the operations of mounting and assembling the container 17 and the corrector cartridge 12 respectively in dependence on the type of typing ribbon 18 and the type of correction ribbon 27 which is accommodated in the container 17 and the corrector cartridge 12 respectively. That therefore results in containers 17 and corrector cartridges 12 which can be coupled together, as illustrated in the drawings.

Figure 3:
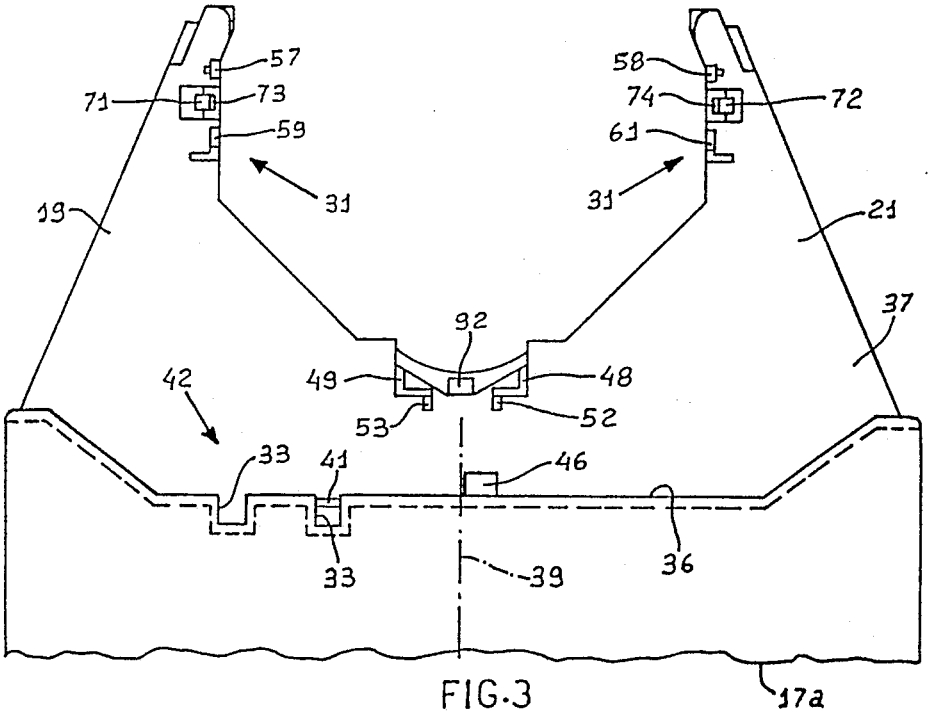
FIG. 3 is a partial view showing some particular features of a cartridge for an inked ribbon as shown in FIG. 1, in the inverted position.
Figure 4:
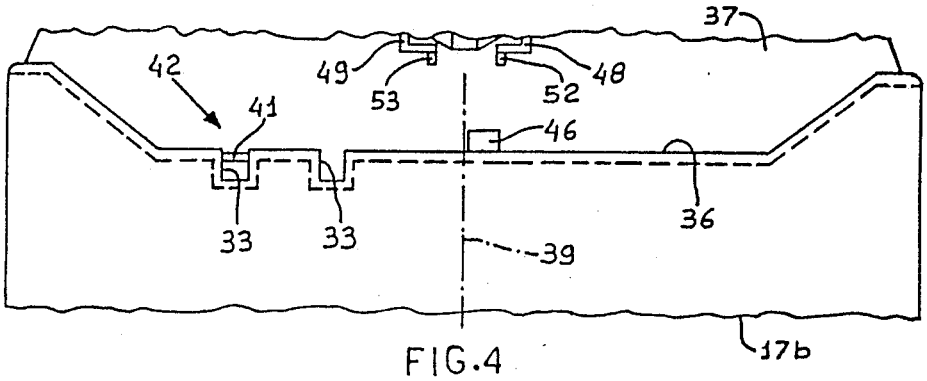
FIG. 4 shows a partial view of some particular features of another cartridge for an inked ribbon as shown in FIG. 1, in an inverted position.
Figure 5:
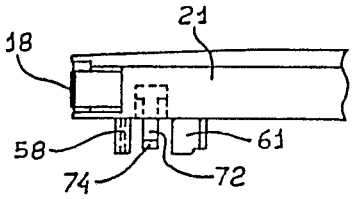
FIG. 5 is a partial side view showing some particular features of a cartridge for an inked ribbon as shown in FIG. 1.
Figure 6:
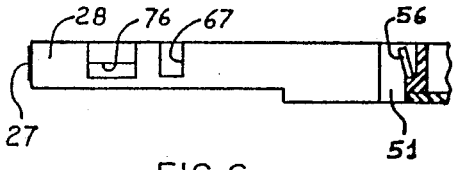
FIG. 6 is a partial side view of some particular features of a cartridge for a correction ribbon as shown in FIG. 1.
Figure 11:
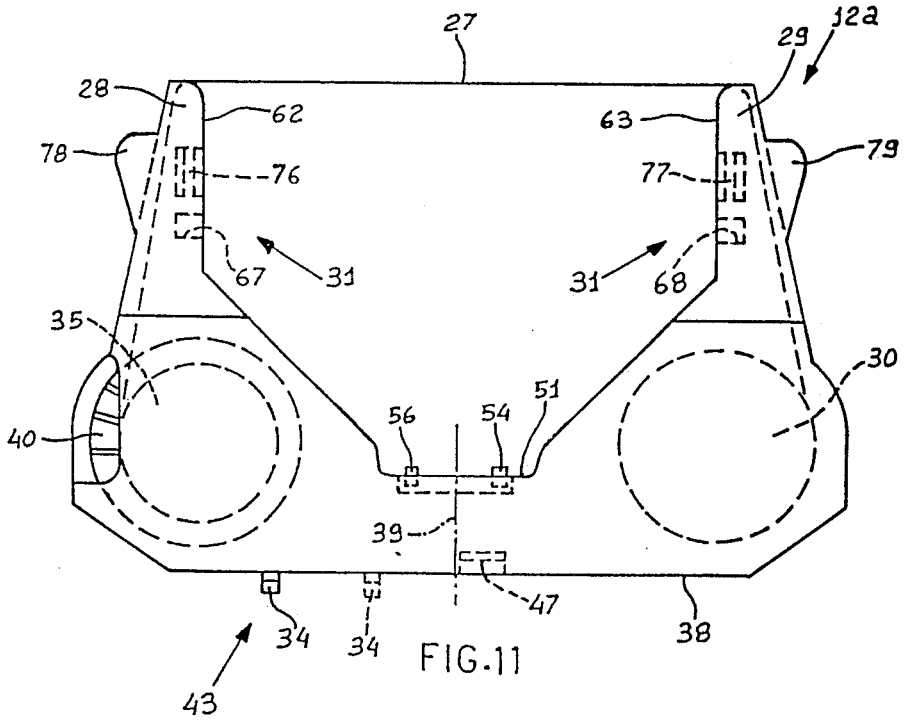
FIG. 11 is a partial view showing some features of the cartridge for a correction ribbon as shown in FIG. 1, in an inverted position.
Figure 12:
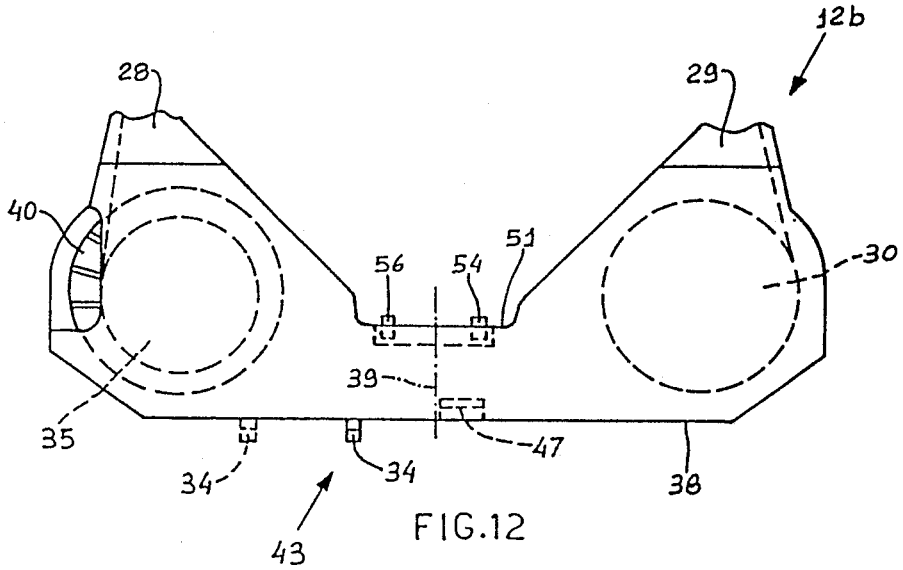
FIG. 12 is a partial view of other features of the cartridge shown in FIG. 11.

By way of example and in order to enhance understanding of the invention, the corrector cartridge 12*a* in FIG. 11 is for a lift-off ribbon 27 and can be coupled to the container 17*a* in FIG. 3 which accommodates a correctable ribbon 18 and the corrector cartridge 12*a* for a cover-up ribbon 27 as shown at 12*b* in FIG. 12 can be coupled to the container 17*b* in FIG. 4, which accommodates a non-erasable ribbon 27. The engagement means 31 on the other hand are the same for the two types of cartridges 17*a* and 17*b*.

The engagement means 31 (see FIGS. 3, 5, 6, 7, 8, 9 and 11) comprise reference engagement means 46 which are in one piece with the container 17 and complementary engagement means 47 which are in one piece with the corrector cartridge 12. Thus the engagement means 31 comprise a hook 46 on the projecting wall 36 of the container 17 and capable of engaging with a shoulder 47 formed by an edge of the rearward wall 38 of the corrector cartridge 12.

Mutual co-operation of the engagement means 31 and the coplanar relationship of the ribbons 18 and 27 is promoted by reference alignment means of the cartridge 11 and complementary alignment means of the corrector cartridge 12. Those means which are not dependent on the type of ribbon 18, 27 accommodated in the cartridges 11 and 12 comprise two guide bars or plates 48 and 49 of L-shaped configuration on the container 17, which are positioned opposite to the hook 46 and are capable of engaging with a space 51 in the corrector cartridge 12 to position the central axis 39 of the corrector cartridge 12 in a position of coincidence with the central axis 39 of the container 17. The two L-shaped guide portions 48 and 49 comprise two ribs 52 and 53 which are positioned towards the hook 46 and which are capable of co-operating with two resilient tongues 54 and 56 which are accommodated in the space 51 in the corrector cartridge 12 to hold the rear wall 38 of the corrector cartridge 12 against the projecting wall 36 of the container 17. In addition each of the arms 19 and 21 of the container 17 comprises a first T-shaped rigid bar or plate 57, 58 which projects from the bottom 37 and which is capable of guiding and positioning the internal side wall 62, 63 of the corresponding arm 28, 29 of the corrector cartridge 12, and a second rigid L-shaped bar or plate 59, 61 which is capable of engaging the bottom of a corresponding space 67, 68 in the arm 28, 29 of the corrector cartridge 12.

The engagement means 31 additionally comprise a resilient, flexible bar or plate 71, 72 which is positioned between the two rigid plates 57 and 59, 58 and 61 and which has at its end a hook 73, 74 which is capable of engaging a shoulder 76, 77 on the arm 28, 29 of the corrector cartridge 12 in order to removably fix the corrector cartridge 12 to the underside of the container 17.

The two arms 28 and 29 (FIGS. 1 and 11) of the corrector cartridge 12 finally comprise two lugs 78 and 79 which project laterally from the arms 28 and 29 and which are capable of being manually engaged to separate the corrector cartridge 12 from the cartridge 11 when the former is fixed to the container 17. The two lugs 78 and 79 are positioned adjacent to the ends of the respective arms 28 and 29.

The following mode of operation is employed for removably fixing the corrector cartridge 12 to the cartridge 11.

As already described hereinbefore, it is necessary to use a container 17 and a corrector cartridge 12 in which the ribbons 18 and 27 are compatible with each other; in accordance with the invention the coupling means 32 will also be compatible. The container 17 is held by means of one hand, in an inverted position, with the bottom facing upwardly, while the other hand is used to grasp the corrector cartridge 12 and to position the limb 34 in the seat 33, keeping the corrector cartridge 12 inclined, and then the cartridge 12 is slowly turned to position it parallel to the container 17. The resilient tongues 54 and 56 then engage the edges 52 and 53 and the L-shaped guides 48 and 49 engage the space 51. By continuing to turn the corrector cartridge 12, the rigid L-shaped bars or plates 59 and 61 engage the bottoms of the spaces 67 and 68 and the rigid T-shaped bars or plates 57 and 58 engage the inward side walls 62 and 63 until the hooks 73 and 74 come into snap engagement with the respective shoulders 76 and 77 and the hook 46 engages with the respective shoulder 47. The container 17 and the corrector cartridge 12 are therefore fixed together: the ribbons 18 and 27 will be in coplanar relationship with each other and the toothed wheel 40 will be unambiguously positioned relative to the toothed wheel 24.

To detach the container 17 from the corrector cartridge 12, the mode of operation is as follows. A slight pressure is applied to the lugs 78 and 79, with the container 17 being held firmly with both hands. The hooks 73 and 74 of the resilient bars or plates 71 and 72 are disengaged from the respective shoulders 76 and 77 and, by continuing the rotational movement, the corrector cartridge 12 is moved away, disengaging it from the container 17.

When the cartridge 11 is positioned in the typewriter, it is supported on a support 86 (see FIGS. 1 and 2) of the machine and it is removably fixed to the support 86 by fixing means which are generally indicated by reference numeral 87. The fixing means 87 comprise two tabs 88 which project from the rear wall 89 of the container 17 and which are capable of engaging under a like number of hooks 91 on the support 86. An element 92 of wedge-shaped configuration projecting from an intermediate front wall 93 between the arms 19 and 21 is capable of co-operating with a resilient tongue 94 on the support 86. The resilient tongue 94 has an intermediate portion 96 of a hook-like configuration which is engaged with the edge of the wedge-shaped element 92 to hold the two tabs 88 engaged with the respective hooks 91 when the container 17 is mounted on the support 86, and an end 97 which is inclined and divergent outwardly in opposite relationship to the hooks 91 to co-operate with the lower edge of the wedge-shaped element 92, thereby to help with insertion of the container 17 and mounting thereof on the support 86.

The following mode of operation is adopted to mount the cartridge 11 on the support 86.

The container 17 is held with one hand and it is first positioned in a slightly inclined position in such a way as to promote engagement of the tabs 88 with the hooks 91 and it is then moved towards the support 86. The lower edge of the wedge-shaped element 92 engages the end 97 of the resilient portion 94 and causes it to bend in the opposite direction to the hooks 91 until the container 17 is against and parallel to the support 86. The resilient portion 94 immediately engages the edge of the wedge-shaped element 92, with the intermediate hook-shaped portion 96; the cartridge 11 is now fixed to the support 86 in such a way as to have the toothed wheel 24 engaged with the driveshaft 26 and the toothed wheel 40 correctly positioned with respect to the ratchet mechanism 45.

To remove the cartridge 11, operation is the reverse to the sequence of operations described above, with the container 17 being held by hand and pulling it upwardly with a light force. Due to the effect of the upward force and by virtue of the action of the wedge-shaped element 92, the resilient portion 94 is bent in the opposite direction to the hooks 91, thus releasing the container 17.

The cartridge 11 may be fixed individually or in conjunction with the corrector cartridge 12 to the support 86 of the machine and the fixing means 87 do not cooperate and interfere with the engagement means 31 and the coupling means 32.

The driveshaft 26, the support 86 and the ratchet mechanism 45 have only been described and illustrated in FIGS. 1 and 2 in diagrammatic and highly simplified form in order not to complicate the description and the drawings, but they are substantially similar to the components described in U.S. Pat. No. 4,637,744.

It will be appreciated that various modifications may be made to the cartridge 11, the corrector cartridge 12 and to the various engagement means 31, alignment means and coupling means 32, both in regard to the shape and the arrangement of the various components, without thereby departing from the scope of the invention as claimed.

If the operator wishes to be able to use a correction cartridge 12 of cover-up type, even on a correctable ribbon cartridge 11, which is obviously not the optimized situation, the cartridge 11 may be without the reference coupling means 32, that is to say it may be provided with seats 33 which are so large as not to interfere with the limb 34 on the cartridge 11, whatever position it may be in. Alternatively the cartridge 12 may be of "universal" type, that is to say it may be without the limb 34 or the equivalent complementary coupling means 33.

Conversely it is also apparent that a cartridge 11 may accommodate different types of erasable typing ribbon 27 which can be cancelled in optimum fashion only by lift-off ribbons 27 which are specifically associated with those ribbons. In that case the cartridge 11 may include selective coupling means which are coded in dependence on the particular nature of the typing ribbon 18. In the last-mentioned situation the correction cartridge 12 will be provided with complementary coupling means which are coded in such a way as to be operative only with the corresponding selective coupling means of the cartridge 11 which is provided with the typing ribbon 18 for which the correction ribbon 27 has been especially designed.

What we claim is:

1. A typing ribbon cartridge for a typewriter, provided to form a unitary typing and correcting cartridge with a correcting cartridge to be mounted as a unit in the typewriter, in which said correcting cartridge comprises a correcting ribbon container, a correcting ribbon lodged in said correcting ribbon container, complementary alignment means, complementary engagement means, and a coupling member of a first kind projecting from the correcting ribbon container, said typing ribbon cartridge comprising a typing ribbon container for lodging a typing ribbon and providing an external portion of the typing ribbon to span externally to said typing ribbon container, and wherein said typing ribbon is compatible with a correcting ribbon of a first kind;

reference alignment means engageable with said complementary alignment means for defining a pre-set relationship of the correcting ribbon container with respect to said typing ribbon cartridge;

reference engagement means for cooperating with said complementary engagement means to fix a correcting cartridge of a first kind with said typing ribbon cartridge in said pre-set relationship to form said unitary typing and correcting cartridge; and coupling means for preventing the typing ribbon cartridge from forming a unitary typing and correcting cartridge with a correcting cartridge different from the first kind of correcting cartridge before the mounting of said typing ribbon cartridge in the typewriter, said correcting cartridge different from the first kind of correcting cartridge comprising a correcting ribbon container, complementary alignment means and complementary engagement means functionally identical to the correcting ribbon container, the complementary alignment means and the complementary engagement means of the first kind of correcting cartridge, respectively, but a correcting ribbon different from the first kind of correcting ribbon and a coupling member different from said first kind of coupling member, said coupling means comprising seat means and strip means in said typing ribbon container;

wherein said seat means are provided for lodging said first kind of coupling member in the pre-set relationship of the first kind of correcting cartridge in order to permit said complementary engagement means to cooperate with said reference engagement means and fix the first kind of correcting cartridge to said typing ribbon cartridge; and wherein said strip means are provided to arrest the coupling member different from the first kind of coupling member for preventing the reference engagement means from cooperating with said complementary engagement means to form said unitary typing and correcting cartridge, when the correcting ribbon container contains a correcting ribbon different from said first kind of correcting ribbon.

2. A typing ribbon cartridge according to claim 1, provided to form a unitary typing and correcting cartridge with a correcting cartridge in which the first kind of coupling member projects from a pre-set position of the correcting ribbon container, wherein said seat means are provided in one of a plurality of pre-set locations of the typing ribbon container and said strip means are lodged at remaining locations of said plurality of pre-set locations, wherein the seat means are provided to receive the first kind of coupling member projecting from said pre-set position and wherein said strip means are provided to arrest a coupling member projecting from positions of a correcting ribbon container different from said pre-set position.

3. A cartridge according to claim 2, wherein the typing ribbon container is made of plastics material and said seat means are provided selectively in one of a plurality of pre-seats in said correcting ribbon container and wherein said plurality of pre-seats is provided to be almost totally closed by a plurality of strips and wherein said seat means are provided by a broken one of said plurality of strips, while said strip means are defined by remaining of all except one of said plurality of strips closing all except one of said plurality of pre-seats.

4. A typing ribbon cartridge according to claim 1 to be used in a typewriter comprising a platen roller, said typing ribbon cartridge being provided to form a unitary typing and correcting cartridge with a correcting cartridge comprising two correcting ribbon arms having two ends for spanning an external portion of the correcting ribbon externally to said correcting ribbon container and a rear wall parallel to said ends, in which said complementary alignment means comprise said rear wall, and in which said coupling member projects from said rear wall, said typing ribbon container comprising a bottom wall and two typing ribbon arms having two respective terminals for arranging the external portion of the typing ribbon to span, in use, parallel to the platen roller, wherein said reference alignment means comprise a reference surface projecting downwardly from said bottom wall parallel to said ends and wherein said reference surface is cooperative with the rear surface of the correcting ribbon container to make the external portion of the typing ribbon cartridge substantially coplanar with the external portion of the correcting ribbon.

5. A typing ribbon cartridge according to claim 4, provided to form a unitary typing and correcting cartridge with a correcting cartridge, in which said complementary-alignment means further comprise two resilient bearing tongues which are provided in the space between said correcting ribbon arms, wherein said reference alignment means further comprise two bearing surfaces projecting downwardly from said bottom wall in a space between the typing ribbon arms and wherein said two bearing surfaces are provided to cooperate with said two resilient bearing tongues to provide said rear surface to bear against said reference surface.

6. A typing ribbon cartridge according to claim 4 provided to form a unitary typing and correcting cartridge with a correcting cartridge, in which said complementary engagement means comprise a bearing edge in said rear wall and two respective shoulders in said ends, and wherein said reference means comprise a hook element projecting from said reference surface which can be coupled with said bearing edge and a pair of resilient yielding hooks which project at the underside from terminal portions of said typing ribbon arms and which are capable of snap engagement with said two shoulders, respectively.

7. A typing ribbon cartridge according to claim 1, provided to form a unitary typing and correcting cartridge with a correcting cartridge of the first kind as constituted by a lift-off correcting cartridge, in which the correcting ribbon is constituted by a lift-off ribbon and the first kind of coupling member is constituted by a lift-off limb member, wherein the typing ribbon, in said typing ribbon cartridge, is constituted by a correctable typing ribbon and in which the seat means are provided to lodge the lift-off limb member while the strip means are provided to arrest a coupling member different from said lift-off limb member and for a correcting ribbon cartridge having a correcting ribbon different from said lift-off ribbon.

8. A typing ribbon cartridge according to claim 7, provided to form a unitary typing and correcting cartridge with a lift-off cartridge in which the lift-off limb member projects from one of two pre-set positions of the correcting ribbon container, wherein said seat means are provided in one of two pre-set locations of the typing ribbon container and said strip means are lodged at the other of said two pre-set locations, wherein the seat means are provided to receive the lift-off limb member projecting from the one of said two pre-set positions and the strip means are located in the other of said two pre-set locations to arrest a coupling member projecting from the other of said two positions of a ribbon container different from said one of two pre-set positions.

9. A typing ribbon cartridge according to claim 8 to be used in a typewriter comprising a platen roller, said typing ribbon cartridge being provided to form a unitary typing and correcting cartridge with a lift-off cartridge comprising two correcting ribbon arms having two ends for spanning an external portion of the correcting ribbon externally to said correcting ribbon container, in which said complementary alignment means comprise a rear wall, in which said complementary engagement means comprise a bearing edge in the rear wall and two respective shoulders in said ends and in which said lift-off limb member projects from a pre-set position of said rear wall, said typing ribbon container comprising a bottom wall, two typing ribbon arms having two respective terminals for arranging the external portion of the typing ribbon to span, in use, parallel to the platen roller, and a reference surface projecting downwardly from said bottom wall parallel to said terminals, wherein said reference surface is cooperative with the rear surface of the correcting ribbon container to make the external portion of the typing ribbon cartridge substantially coplanar with the external portion of the correcting ribbon, wherein said seat means comprise an opening in a pre-set location of said reference surface, while said strip means comprise a strip closing another opening in said reference surface in a second pre-set location and wherein said reference engagement means comprise a hook element projecting from said reference surface and which can be coupled with said bearing edge and two resilient yielding hooks which project at the underside from said two terminals and which are capable of snap engagement with said two shoulders, respectively.

10. A typing ribbon cartridge according to claim 8 to be used in a typewriter comprising a platen roller, said typing ribbon cartridge being provided to form a unitary typing and correcting cartridge with a lift-off cartridge comprising two correcting ribbon arms having two ends for spanning an external portion of the correcting ribbon externally to said correcting ribbon container and a rear wall parallel to said ends, and in which said complementary alignment means comprise said rear wall, said typing ribbon container comprising a bottom wall and two typing ribbon arms having two respective terminals for arranging the external portion of the typing ribbon to span, in use, parallel to the platen roller, wherein said reference alignment means comprise a reference surface projecting downwardly from said bottom wall parallel to said ends, wherein said reference surface is cooperative with the rear surface of the correcting ribbon container to make the external portion of the typing ribbon cartridge substantially coplanar with the external portion of the correcting ribbon, and wherein the pre-set means are openings in said reference wall which are almost totally closed by two respective strips, said seat means being obtained by a broken one of said two strips, while said strip means being defined by the other of said two strips closing the opening in the other of said two pre-set locations.

11. A typing ribbon cartridge according to claim 1, provided to form a unitary typing and correcting cartridge with a correcting cartridge of the first kind as constituted by a cover-up correcting cartridge, in which the correcting ribbon is constituted by a cover-up ribbon and the first kind of coupling member is constituted by a cover-up limb member, wherein the typing ribbon, in said typing ribbon cartridge, is constituted by a non-erasable typing ribbon and in which the seat means are provided to lodge the cover-up limb member while the strip means are provided to arrest a coupling member different from said cover-up limb member and for a correcting ribbon cartridge having a correcting ribbon different from said cover-up ribbon.

12. A typing ribbon cartridge to be used in a typewriter comprising a platen roller, said typing ribbon cartridge being provided to form a unitary typing and correcting cartridge with a correcting cartridge comprising a correcting ribbon container, a correcting ribbon lodged in the correcting ribbon container, complementary alignment means, complementary engagement means, and two correcting ribbon arms having two respective ends for spanning an external portion of the correcting ribbon externally to said correcting ribbon container, in which said complementary alignment means comprise a rear wall parallel to said ends and two resilient bearing tongues between said correcting ribbon arms, and in which said complementary engagement means comprise a bearing edge in said rear wall and two respective shoulders in said ends, said typing ribbon cartridge comprising a typing ribbon container for lodging a typing ribbon and comprising a bottom wall and two typing ribbon arms having two respective terminals for arranging the external portion of the typing ribbon to span, in use, parallel to the platen roller;

reference alignment means engageable with said complementary alignment means to make the external portion of the typing ribbon cartridge substantially coplanar with the external portion of the correcting ribbon; and reference engagement means for cooperating with said complementary engagement means to fix a correcting cartridge with said typing ribbon cartridge to form said unitary typing and correcting cartridge;

wherein said reference alignment means comprise a reference surface projecting downwardly from said bottom wall parallel to said ends for cooperating with the rear surface of the correcting ribbon container and two bearing surfaces projecting downwardly from said bottom wall in a space between the typing ribbon arms for cooperating with the two resilient bearing tongues of the correcting ribbon container to provide said rear surface to bear against said reference surface; and wherein said reference engagement means comprise a hook element projecting from said reference surface for cooperating with said bearing edge and a pair of resilient yielding hooks which project at the underside from terminal portions of said typing ribbon arms for a snap engagement with said two shoulders, respectively.

13. A typing ribbon cartridge according to claim 12, wherein said reference alignment means further comprise two substantially rigid alignment bars which project at the underside from the terminal portions of said typing ribbon arms adjacent to said yielding hooks, said bars being provided to be coupled exactly with respective surfaces of the correcting ribbon arms and representing further parts of said complementary-alignment means.

14. A typing ribbon cartridge according to claim 12, provided to form a unitary typing and correcting cartridge with a correcting cartridge further providing a coupling member projecting from said rear wall, wherein the reference engagement means in said typing ribbon cartridge are provided to fix a correcting cartridge of a first kind, in which said typing ribbon is compatible with a correcting ribbon of a first kind, and in which said typing ribbon cartridge further comprises coupling means for preventing the typing ribbon cartridge from forming a unitary typing and correcting cartridge with a correcting cartridge different from the first kind of correcting cartridge before the mounting of said typing ribbon cartridge in the typewriter, said correcting cartridge different from the first kind of correcting cartridge comprising a correcting ribbon container, complementary alignment means and complementary engagement means functionally identical to the correcting ribbon container, the complementary alignment means and the complementary engagement means of the first kind of correcting cartridge, respectively, but a correcting ribbon different from the first kind of correcting ribbon and a coupling member different from said first kind of coupling member, said coupling means comprising seat means and strip means in the reference surface of said typing ribbon container;

wherein said seat means are provided for lodging said first kind of coupling member in the pre-set relationship of the first kind of correcting cartridge in order to permit said complementary engagement means to cooperate with said reference engagement means and fix the first kind of correcting cartridge to said typing ribbon cartridge; and wherein said strip means are provided to arrest the coupling member different from the first kind of coupling member for preventing the reference engagement means from cooperating with said complementary engagement means to form said unitary typing and correcting cartridge, when the correcting ribbon container contains a correcting ribbon different from said first kind of correcting ribbon.

15. A correcting cartridge for a typewriter, provided to form a unitary typing and correcting cartridge with a typing ribbon cartridge to be mounted as a unit in the typewriter, in which said typing ribbon cartridge comprises a typing ribbon container, a typing ribbon lodged in said typing ribbon container, reference alignment means, reference engagement means, and seat means and strip means of a first kind in the typing ribbon container, said correcting cartridge comprising a correcting container for lodging a correcting ribbon and providing an external portion of the correcting ribbon to span externally to said correcting container, and wherein said correcting ribbon is compatible with a typing ribbon of a first kind;

complementary alignment means engageable with said reference alignment means for defining a pre-set relationship of the typing ribbon container with respect to said correcting cartridge;

complementary engagement means for cooperating with said reference engagement means to fix said correcting cartridge with a typing ribbon cartridge of a first kind in said pre-set relationship, to form said unitary typing and correcting cartridge; and coupling means for preventing said correcting cartridge from forming a unitary typing and correcting cartridge with a typing ribbon cartridge different from the first kind of typing ribbon cartridge before the mounting of said typing ribbon cartridge in the typewriter, said typing ribbon cartridge different from the first kind of typing ribbon cartridge comprising a typing ribbon container, reference alignment means and reference engagement means functionally identical to the typing ribbon container, the reference alignment means and the reference engagement means of the first kind of typing ribbon cartridge, respectively, but a typing ribbon different from the first kind of typing ribbon and seat means and strip means different from said first kind of seat means and strip means, said coupling means comprising a coupling member projecting from said correcting container;

wherein said coupling member is provided for being lodged in said first kind of seat means in the pre-set relationship of the first kind of typing ribbon cartridge in order to permit said complementary engagement means to cooperate with said reference engagement means and fix the first kind of typing ribbon cartridge to said correcting cartridge; and wherein said coupling member is provided to be arrested by the strip means different from the first kind of strip means for preventing the reference engagement means from cooperating with said complementary engagement means to form said unitary typing and correcting cartridge, when the typing ribbon container contains a typing ribbon different from said first kind of typing ribbon.

16. A correcting cartridge according to claim 15, provided to form a unitary typing and correcting cartridge with a typing ribbon cartridge in which the first kind of seat means are located in one of a plurality of pre-set locations of the typing ribbon container and said strip means are lodged at remaining locations of said plurality of pre-set locations, wherein said coupling member projects from one of a plurality of pre-set positions, wherein the first kind of seat means are provided to receive said coupling member projecting from said pre-set position and wherein said coupling member is provided to be arrested by strip means lodged in locations of a typing ribbon container different from said one of said pre-set locations.

17. A correcting ribbon cartridge according to claim 36 to be used in a typewriter comprising a platen roller, said correcting cartridge being provided to form a unitary typing and correcting cartridge with said typing ribbon cartridge comprising a typing ribbon container including a bottom wall and two typing ribbon arms having two respective terminals for arranging an external portion of the typing ribbon to span, in use, parallel to the platen roller, wherein said reference alignment means include a reference surface projecting downwardly from said bottom wall parallel to said terminals, wherein said reference engagement means comprise a hook element projecting from said reference surface and two resilient hooks projecting at underside from said terminals, and wherein said seat means comprise an opening in said reference surface, said correcting cartridge comprising two correcting ribbon arms having two ends for spanning the external portion of the correcting ribbon externally to said correcting ribbon container and a rear wall parallel to said ends, in which said complementary alignment means comprise said rear wall which is cooperative with the reference surface of the typing ribbon container to make the external portion of the correcting ribbon cartridge substantially coplanar with the external portion of the typing ribbon, in which said complementary engagement means comprise a bearing edge in the rear wall and two respective shoulders in said ends and in which said coupling member comprises a limb member projecting from a pre-set position of said rear wall, wherein said bearing edge is engageable with said hook element and said shoulders are engageable by said resilient hooks through a snap engagement, respectively, and wherein said limb member is engageable in said opening.

18. A correcting cartridge according to claim 17, wherein said correcting ribbon arms comprise two respective lugs projecting laterally from said arms and capable of being manually engaged to separate said correcting cartridge from the typing ribbon cartridge.

19. Connectable cartridges for compatible typing and correction ribbons for a typewriter, comprising a typing ribbon cartridge and a correcting cartridge forming a unitary typing and correcting cartridge to be mounted as a unit in the typewriter, in which said correcting cartridge comprises a correcting ribbon container, a correcting ribbon lodged in said correcting ribbon container, complementary alignment means, and complementary engagement means; and in which said typing ribbon cartridge comprises a typing ribbon container, a typing ribbon lodged in said typing ribbon container, wherein said typing ribbon is compatible with a correcting ribbon of a first kind and wherein the typing ribbon container provides an external portion of the typing ribbon to span externally to said typing ribbon container, reference alignment means engageable with said complementary alignment means for defining a pre-set relationship of the correcting ribbon container with respect to said typing ribbon cartridge, and reference engagement means for cooperating with said complementary engagement means to fix a correcting cartridge of a first kind with said typing ribbon cartridge in said pre-set relationship to form said unitary typing and correcting cartridge; and wherein said compatible cartridges further comprise coupling means for preventing the typing ribbon cartridge from forming a unitary typing and correcting cartridge with a correcting cartridge different from the first kind of correcting cartridge before the mounting of said typing ribbon cartridge in the typewriter, said coupling means comprising a coupling limb member projecting from one of two pre-set positions of the correcting ribbon container;

seat means in one of two pre-set locations of said typing ribbon container; and strip means in the other of the two pre-set locations of said ribbon container;

wherein said correcting cartridge different from the first kind of correcting cartridge comprises a correcting ribbon container, complementary alignment means and complementary engagement means functionally identical to the correcting ribbon container, the complementary alignment means and the complementary engagement means of the first kind of correcting cartridge, respectively, but a correcting ribbon different from the first kind of correcting ribbon and a coupling member projecting from the other of said two pre-set positions different from said one of two pre-set positions;

wherein said seat means are provided for lodging said coupling limb member in the pre-set relationship of the first kind of correcting cartridge in order to permit said complementary engagement means to cooperate with said reference engagement means and fix the first kind of correcting cartridge to said typing ribbon cartridge; and wherein said strip means are provided to arrest the coupling member different from the coupling limb member for preventing the reference engagement means from cooperating with said complementary engagement means to form said unitary typing and correcting cartridge, when the correcting ribbon container contains a correcting ribbon different from said first kind of correcting ribbon.

* * * * *